United States Patent [19]

Horsch

[11] Patent Number: 4,898,075

[45] Date of Patent: Feb. 6, 1990

[54] HYDRAULICALLY ACTUATED INDEXING MECHANISM

[75] Inventor: Joachim Horsch, Lombard, Ill.

[73] Assignee: J. I. Case Company, Racine, Wis.

[21] Appl. No.: 204,575

[22] Filed: Jun. 9, 1988

[51] Int. Cl.[4] ..... F01B 1/00

[52] U.S. Cl. ..... 91/477; 91/189 R; 91/193; 91/194

[58] Field of Search ..... 91/194, 534, 192, 193, 91/170 R, 189 R, 477, 491, 472

[56] References Cited

U.S. PATENT DOCUMENTS

| | | | |
|---|---|---|---|
| 2,563,622 | 8/1951 | Scott | 91/194 X |
| 2,644,309 | 7/1953 | Detrez | 91/193 X |
| 3,661,059 | 5/1972 | Hunter et al. | 91/194 X |
| 3,848,515 | 11/1974 | Gardineer et al. | 91/192 X |
| 4,062,219 | 12/1977 | Chuparov et al. | 91/194 X |
| 4,598,627 | 2/1986 | Brisland | 91/192 X |

*Primary Examiner*—Edward L. Look

*Attorney, Agent, or Firm*—Dressler, Goldsmith, Shore, Sutker & Milnamow, Ltd.

[57] ABSTRACT

An indexing mechanism comprising a member adapted to be advanced a predetermined amount and along a predetermined path, a pair of spaced drivers, and a control valve for operating the drivers in an alternative manner. The member adapted to be advanced defines a profile surface including a plurality of spaced radial segments. Each radial segment includes a crown section which is joined to an adjacent crown section by two oppositely directed ramps defining a fillet radius therebetween. The spacing between the drivers being such that when one driver is urged against a crown section the other driver acts against a fillet radius. The drivers are operated by the control valve 180° out of phase relative to each other. A driver, after moving off a crown section, coacts with ramp to impart a driving force to the member. The driving force being sufficient to move the member in an indexed fashion the predetermined amount of its movement.

18 Claims, 4 Drawing Sheets

HYDRAULICALLY ACTUATED INDEXING MECHANISM

FIELD OF THE INVENTION

The present invention relates to an actuating mechanism and, more particularly, to a mechanism for driving a member along a predetermined path in an indexed fashion.

BACKGROUND OF THE INVENTION

There is a need in industry to provide a mechanism which will drive a member in an indexed fashion. Preferably, such mechanism will require relatively low efforts to begin the indexing operation yet will generate high forces to move the member between indexed positions.

In addition to effecting such ends, such a drive mechanism is required to meet the following design criteria. First, after indexing the driven member into position, the drive mechanism must hold the member in its new indexed position until a certain low force is applied against the member. Second, after a certain low force is applied against the member for a certain small distance of the member's travel, a relatively high actuating force is to be applied against the member. This relatively high actuating force is used to drive the member in an indexed fashion through at least one position without requiring any additional externally applied force against the member. Third, after indexing the member into position, the drive mechanism should hold the indexed member in position for a certain time (to prevent overshifting) before the relatively high actuating force applied against the member is lowered. Finally, the drive mechanism should allow multiple indexed movements of the member in quick succession without significant resistance.

Known prior art mechanism are not capable of both meeting industry's need and satisfying all of the above design criteria.

SUMMARY OF THE INVENTION

In line with the above, and in accordance with the present invention, there is provided an indexing mechanism which requires relatively low efforts to initiate the indexing process but which will generate relatively high forces to rapidly move a member between indexed positions. The indexing mechanism includes a member adapted to be indexed into position, a pair of hydraulic drivers, and means for directing a relatively high driving force, in the form of pressurized hydraulic fluid, to each driver in an alternative manner.

According to one aspect of the present invention, the indexing mechanism comprises a member which is adapted to be advanced a predetermined amount and along a predetermined path. The member defines a profile surface including a plurality of equally spaced tooth segments. Each tooth segment has a crown section which is joined to an adjacent crown section by two oppositely directed ramps. A fillet radius is defined between the ramps. Each fillet radius is spaced from a crown section by a predetermined distance.

A pair of spaced apart drivers are urged against the profile surface of the member. The spacing between the drivers is such that when one driver is urged against a crown section on the profile of the member, the other driver acts against a fillet radius. The drivers are operated in an alternative manner, and function in the nature of hydraulic rams or pistons for effecting driven movement of the indexed member.

The present invention further includes means for supplying a relatively high driving force to each driver in an alternative manner. An energizing or driving force (i.e., pressurized hydraulic fluid in the illustrated embodiment) is selectively supplied to that driver acting against a crown section such that, after the member moves a certain small distance, the member is rapidly indexed toward its next position as the driver acts against one of the ramps adjacent to the crown section. The member is then held in its new indexed position until a certain low force is applied against the member.

In a preferred form of the invention, each crown section includes an extended flat. The extended flat permits the indexed member to move a certain small distance before the energized driver coacts with a ramp to impart a relatively high driving force to the member.

Each driver includes a roller which acts against the profile surface of the indexed member. Each fillet radius of the indexed member is slightly larger than the radius of the roller so as to provide relatively small acceleration forces when the indexed member begins to move.

Each driver further includes a valve spool which is reciprocally arranged in a ported valve body and which is connected to the drive roller. Each valve spool is resiliently urged toward the profile surface of the movable member under the influence of a relatively low force, provided by spring means in the illustrated embodiment. According to the present invention, each valve spool is operably interposed between the source of fluid pressure and the means for supplying a drive force to each driver.

In a preferred form of the invention, the means for supplying the driving force includes a shuttle spool adapted for linear movement in the ported valve body. The linear disposition of the shuttle valve in the valve body controls operation of each driver in either a driving phase or a positioning phase.

The shuttle spool operates to energize a driver to act against the member with a relatively high force for a short time after the member is indexed into position. Such operation allows the drive roller to coact with a fillet radius to prevent over shooting of the member. The shuttle spool then lowers the pressure acting on that driver and applies it to the other driver.

According to another aspect of the present invention there is provided an actuating mechanism for moving a rotatable member through distinct angular positions. The rotatable member defines a profiled peripheral surface including a plurality of equally spaced radial or tooth segments. Each tooth segment has a generally flat crown section which is joined to an adjacent crown section by at least two oppositely directed ramps. A fillet radius is defined between the oppositely directed ramps.

A pair of spaced, hydraulically operated drivers are urged against the profile of the member. The spacing between the drivers being such that when one driver is urged against the crown section of the rotatable member the other driver acts against a fillet radius.

The actuating mechanism further includes means for supplying a pressurized source of fluid to each of the drivers in an alternative manner. By such construction, a driver, after moving off the crown section of the rotatable member, pushes against a ramp thereby imparting a torque to the rotatable member. Such torque is sufficient to rotationally advance the member while the other driver moves toward a crown section.

Each driver includes a reciprocally arranged valve spool. Each valve spool is positioned within a valve body as a function of the angular disposition of the rotatable member. Moreover, the means for supplying a pressurized source of fluid includes a shuttle spool which is likewise reciprocally arranged in the valve body for movement along a linear path. The linear position of the shuttle spool is regulated by the position of each valve spool in the valve body. Furthermore, the shuttle spool includes a pilot spool coaxially arranged to reciprocate in the shuttle spool in a manner regulating fluid flow to each driver. The shuttle spool and pilot spool cooperate with the valve body to allow multiple indexed movements of the member in quick succession without significant resistance.

According to a further aspect of the invention, there is provided an actuating mechanism which satisfies industry's need and meets the criteria described above. Such actuating mechanism comprises a cam which is rotatable about an axis and is adapted to be advanced into distinct angular positions. In one form if the invention, the cam forms part of a transmission control assembly. The cam defines a profiled surface including a plurality of equally spaced radial segments. Each radial segment has a crown section which is joined to an adjacent crown section by at least two oppositely directed ramps. A fillet radius is defined between the ramp sections.

First and second cam drivers are arranged to follow and be resiliently urged against the profiled surface of the cam. Each cam driver is operable in a driving phase and a positioning phase. The cam drivers are arranged relative to each other such that when one cam driver acts against a crown section, the other cam driver is arranged to act against a fillet radius.

A control valve regulates application of a relatively high driving force to each cam driver. The control valve regulates the cam drivers in an alternative manner. That is, a relatively high pressure driving force is applied to the cam drivers such that they are operated 180° out of phase relative to each other.

Each cam driver preferably includes a roller which coacts with one of the ramps to provide a constant torque on the cam during the driving phase of its operation. The roller of the cam driver then coacts with a fillet radius to position the cam during positioning phase of operation. Each cam driver further includes a valve spool reciprocally arranged in a ported valve body and connected to the cam. The ported valve body further supports the cam for rotation. Each valve spool is operably interposed between a source of fluid pressure and the control valve.

The control valve includes a shuttle spool which is reciprocally arranged in the valve body for linear movement along a straight line path. The linear position of the shuttle spool is regulated by the position of the valve spools in the valve body. The shuttle spool preferably includes a pilot spool which is coaxially arranged to reciprocate within the shuttle spool in a manner regulating fluid flow to each of the drivers.

Other features and advantages of the present invention will become readily apparent from the following detailed description, appended drawings, and the accompanying claims.

DETAILED DESCRIPTION OF A PREFERRED EMBODIMENT

Figure 1:
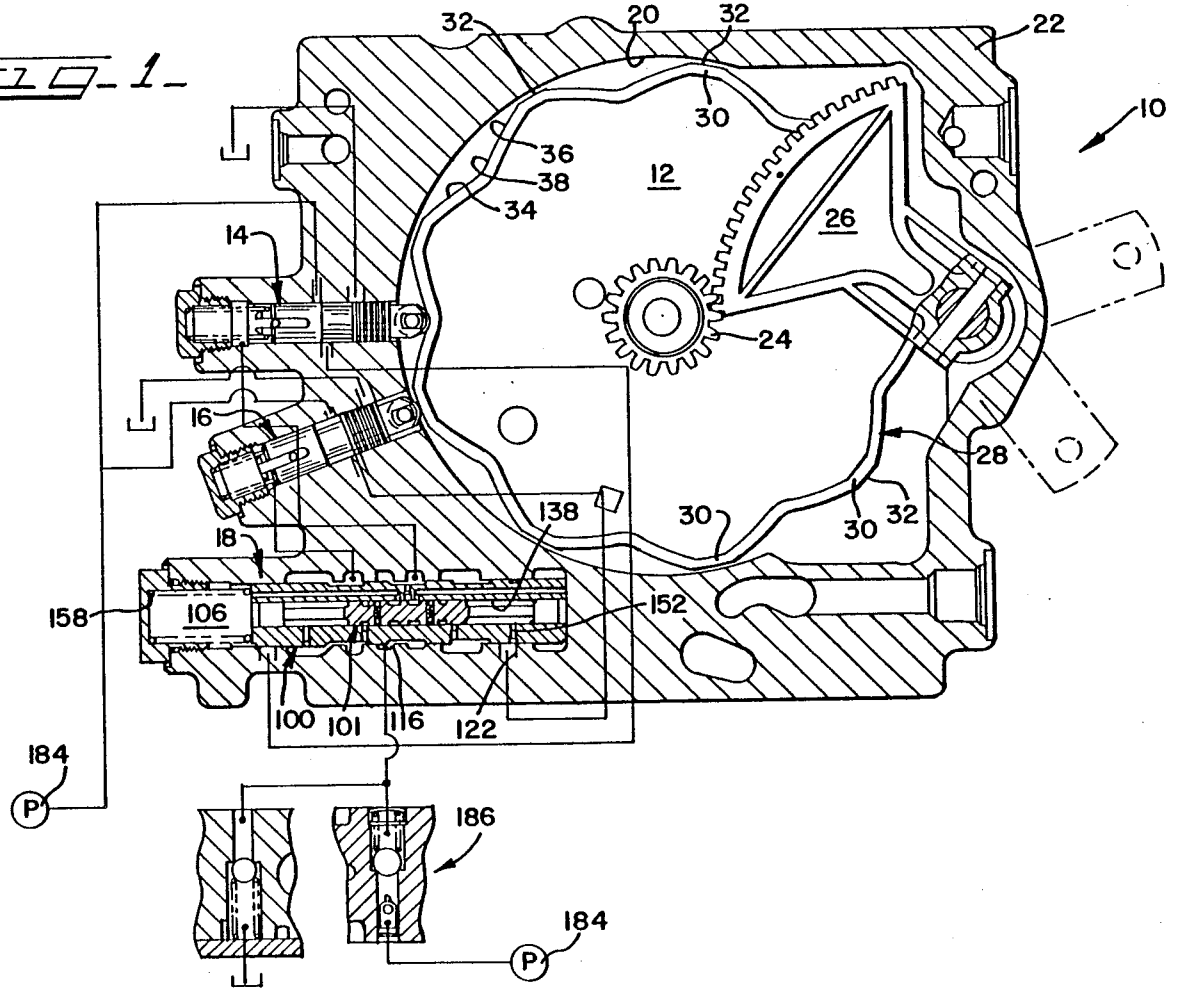
FIGS. 1 through 4 are similar front elevational views, each partially in section, schematically illustrating component parts of the present invention and their relationship during various stages of operation of the present invention.

While the present invention is susceptible of embodiment in various forms, there is shown in the drawings a presently preferred embodiment hereinafter described, with the understanding that the present disclosure is to be considered as an exemplification of the invention, and is not intended to limit the invention to specific embodiment illustrated.

Referring now to the drawings, wherein like reference numerals refer to like parts throughout the several views, there is shown an indexing mechanism 10. The indexing mechanism 10 includes a driven member 12, a pair of spaced apart drivers 14 and 16, and a control valve assembly 18 for supplying a driving force to each of the drivers 14, 16 in an alternative manner. The driven member 12 is adapted to be advanced a predetermined amount and along a predetermined path of travel.

In the preferred embodiment, the driven member 12 is a rotatably driven cam. As one example of a particular application, the driven cam member 12 forms part of a transmission control assembly. The transmission control assembly may be of the type disclosed in my copending application Ser. No. 190,493, filed May 5, 1988, which is now U.S. Pat. No. 4,844,127.

Cam member 12 is mounted for rotation in a cavity 20 defined by a valve body 22 such that it can be advanced into distinct angular positions. It should be appreciated, however, that the principles of the present invention equally apply to a member which is driven along straight line or curvilinear paths.

As illustrated, cam member 12 includes a drive gear 24 which is in constant mesh with a gear or rack 26. As it will be appreciated, movement of the gear or rack 26 will impart initial movement to the cam member 12.

Cam member 12 defines a profile surface 28 including a plurality of spaced tooth or radial segments 30. In the illustrated embodiment, profile surface 28 is provided with equally spaced radial segments which are provided on a peripheral edge of the cam member 12. Each tooth segment 30 has a crown section 32 which is joined to an adjacent crown section by at least two oppositely directed ramps 34 and 36 defining a fillet radius 38 therebetween. Each ramp preferably has a curvilinear profile. Each fillet radius is spaced from a crown section 32 by a predetermined distance. In the illustrated embodiment, crown section 32 includes by a circular flat provided on the peripheral edge of the cam member 12.

Drivers 14 and 16 are arranged to follow and be resiliently urged against the profile surface 28 of the cam member 12. Each driver 14, 16 is operable in a driving phase and a positioning phase depending on its position within the valve body. Drivers 14, 16 are carried by the valve body 22 and are suitably arranged therein such that when one driver is urged against a crown section of the cam member 12, the other driver acts against a fillet radius.

Figure 2:
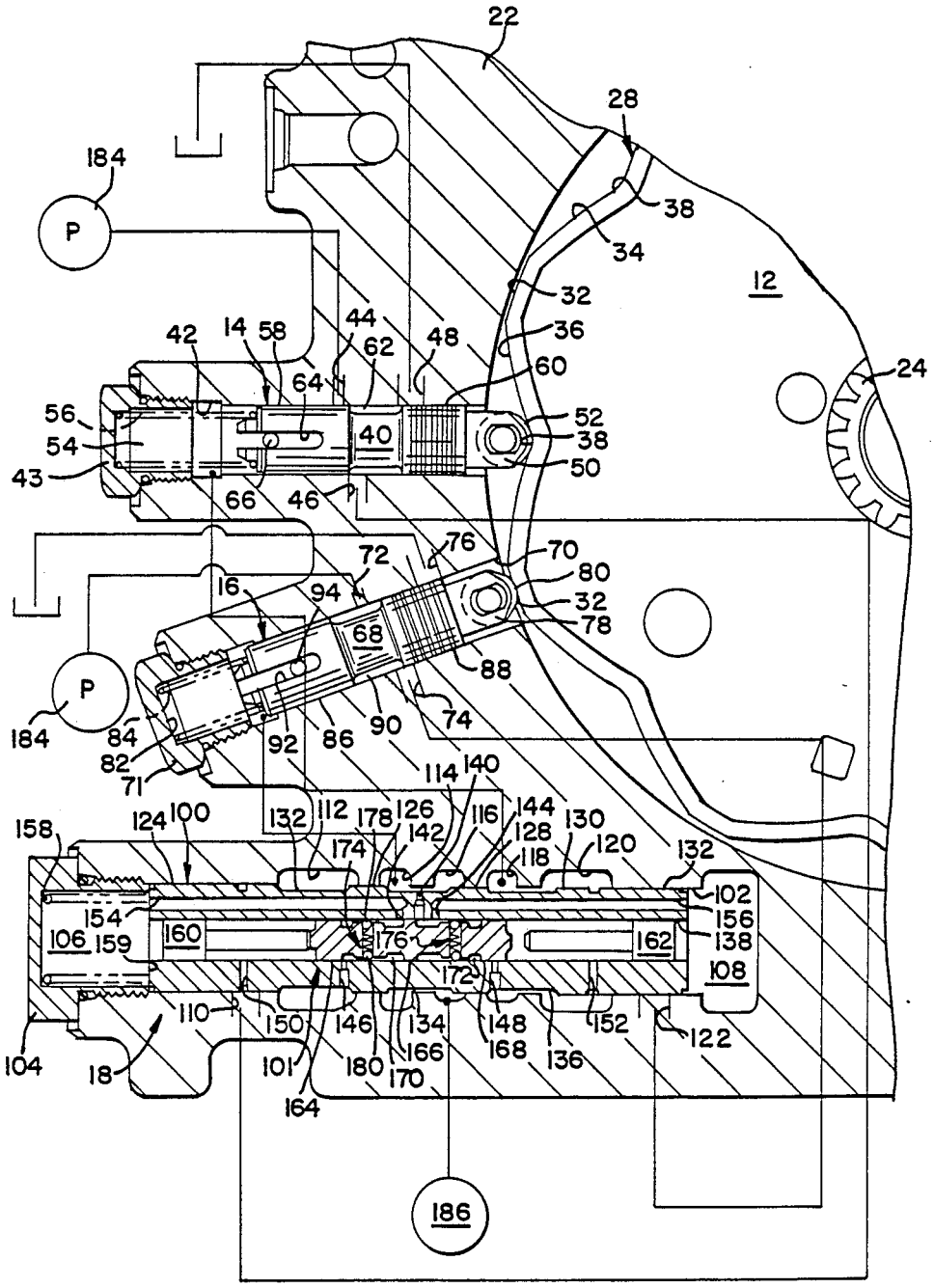

As best illustrated in FIG. 2, driver 14 includes a valve spool 40 which is reciprocally arranged in a axial bore 42 defined by valve body 22. Valve spool 40 is positioned in bore 42 as a function of the angular disposition of cam member 12. A plurality of axially spaced ports 44, 46 and 48 intersect with the axial bore 42. As illustrated, port 44 defines an inlet port. Port 46 fluidically joins driver 14 with control valve assembly 18. Port 44 defines an exhaust port.

Projecting from the valve spool 40, toward the profile surface 28 of cam member 12, is a clevis 50. A free roller 52 is carried by the clevis 50. Roller 52 has a radius which is slightly smaller than that of fillet radius 38 so as to provide good detent positioning and yet relatively small acceleration forces.

A closure member 43 seals one end of axial bore to define a fluid receiving expansible chamber 54 arranged rearwardly of valve spool 40. A spring 56 is arranged in chamber 54. Spring 56 urges valve spool 40 and, thereby, roller 52 against the profile surface 28 of the cam member 12 under a relatively low or light force.

Valve spool section, 40 includes two axially spaced lands 58 and 60 which define a groove 62 therebetween. Land 58 includes an axially elongated slot 64 which cooperates with a stationary pin 66 provided in the valve body 22. By such construction, the driver 14 is permitted to axially reciprocate in bore 42 but is prevented from rotating about its longitudinal axis.

Driver 16 includes a valve spool 68 which is reciprocally arranged in an axial bore 70 defined by valve body 22 as a function of the angular disposition of cam member 12. A plurality of axially spaced ports 72, 74, and 76 intersect with the axial bore 70. As illustrated, port 72 defines an inlet port. Port 74 fluidically joins driver 16 with control valve assembly 18. Port 76 defines an exhaust port.

Projecting from the valve spool 68 toward the profile surface 28 of cam member 12 is a clevis 78. A free roller 80 is carried by the clevis 78. Roller 80 has a radius which is slightly smaller than that of fillet radius 38 so as to provide relatively small acceleration forces.

A closure member 71 seals one end of axial bore 70 to define a fluid receiving expansible chamber 82 arranged rearwardly of valve spool 68. A spring 84 is arranged in chamber 82. Spring 84 urges the valve spool 68 and, thereby, roller 80 against the profiled surface 28 of the cam number 12 under a relatively low or light force.

Valve spool section 68 includes two axially spaced lands 86 and 88 which define a groove 90 therebetween. Land 86 includes an axially elongated slot 92 which cooperates with a stationary pin 94 provided in the valve body 22. By such construction, driver 16 is permitted to axially reciprocate in bore 70 but is prevented from rotating about its longitudinal axis.

The control valve assembly 18 is provided to supply a driving force to each of the drivers 14, 16 in an alternative manner such that the drivers are operated 180° out of phase relative to each other. In its preferred form, the control valve assembly 18 includes a shuttle spool 100 and a pilot spool 101 coaxially arranged therein. The shuttle spool 100 operates in response to signals from the drivers 14 and 16. As will be described, shuttle spool 100 accepts signals from the drivers 14 and 16 and, in turn, sends a signal to the pilot spool 101. Pilot spool 101 acts to direct pressure to opposite ends of the shuttle spool 100 to move spool 100 in a delayed fashion.

To effect such ends, and as best seen in FIG. 2, shuttle spool 100 is reciprocally arranged for endwise linear movement in a blind axial bore 102 defined by the valve body 22. A closure member 104 seals the open end of axial bore 102. Fluid receiving chambers 106 and 108, defined by closure member 104 and axial bore 102, respectively, are provided at opposite ends of the shuttle spool 100. Valve body 22 further defines a series of axially spaced ports 110, 112, 114, 116, 118, 120 and 122 each of which intersects with axial bore 102.

Port 46 leading from driver 14 is joined in fluid communication with port 110 leading to control valve assembly 18. Port 74 leading from driver 16 is joined in fluid communication with port 122 of control valve assembly 18. Port 114 leading from control valve assembly 18 is joined in fluid communication with chamber 82 of driver 16. Port 118 leading from control valve assembly 18 is joined in fluid communication with chamber 54 of driver 14. Ports 112 and 120 of control valve assembly 18 are exhaust ports.

Shuttle spool 100 includes a series of axially spaced lands 124, 126, 128 and 130. A peripheral groove 132 is provided intermediate lands 124 and 126. A peripheral groove 134 is also provided intermediate lands 126 and 128. A peripheral groove 136 is further provided intermediate lands 128 and 130. Shuttle spool 100 further defines an axial bore 138. Located centrally along its axial length, shuttle spool 100 defines a radially extending orifice 140 which leads from axial bore 138 and opens to peripheral groove 134.

Shuttle spool 100 further defines a series of other radially extending, axially spaced orifices 142, 144, 146, 148, 150 and 152 each of which open to axial bore 138. Orifices 142, 146 and 150 are symmetrically arranged along the axial length of spool 100 relative to orifices 144, 148 and 152, respectively. Moreover, orifices 142, 144, 146, 148, 150 and 152 are symmetrically arranged along the axial length of spool 100 relative to the longitudinal axis of port 140. Orifice 142 also opens to an axially extending blind bore 154 which is in fluid communication with fluid receiving chamber 106. Similarly, orifice 144 opens to an axially extending blind bore 156 which is in fluid communication with fluid receiving chamber 108. Besides opening to axial bore 138, radially extending orifices 146 and 148 also open to peripheral grooves 132 and 136, respectively. Orifices 150 and 152, alternatively communicate with radial ports 110 and 122, respectively, depending upon the linear position of shuttle spool 100 within the valve body 22. A spring 158 or other suitable resilient member is arranged in chamber 106 to normally urge shuttle spool 100 to the right as seen in FIG. 1 of the drawings.

Returning to FIG. 2, pilot spool 101 is slidably arranged for endwise sliding movement in axial bore 138 of shuttle spool 100. The extent of linear movement of pilot spool 101 is regulated by a pair of limit stops 160, 162 which are coaxially arranged in axial bore 138 in a symmetrical manner relative to orifice 140.

Pilot spool 101 includes lands 164, 166 and 168 with peripheral grooves 170 and 172 being disposed between lands 164, 166 and 166 and 168, respectively. Land 166 is centrally located along the axial length of spool 101.

Pilot spool 101 further includes a pair of brake assemblies 174 and 176 preferably arranged intermediate lands 164, 166 and 166, 168 respectively. In its preferred form, each brake assembly includes a set of spring loaded spherical balls 178 and 180. Balls 178 and 180 are forced against the wall of axial bore 138 to create a frictional drag force. Such frictional drag force prevents pilot spool 101 from "floating" into a center position between the limit stops 160, 162 due to acceleration forces imparted thereto by movement of shuttle spool 100 when no pressure forces act against the spool 101.

Returning to FIG. 1, a source of fluid pressure 184, which can be a fluid pump or the like, directs fluid pressure to each of the drivers 14 and 16. More specifically, pump 184 continually and simultaneously directs relatively high fluid pressure to ports 44 and 72 of drivers 14 and 16, respectively. Furthermore, pump 184 directs fluid pressure to a pressure regulator assembly 186. Any suitable pressure regulator apparatus capable of modulating the fluid pressure received from pump 184 will suffice and, thus, no further discussion need be devoted thereto. The pressure regulator 186 directs a regulated relatively high fluid pressure to port 116 of valve 18.

Operation of the indexing mechanism 10 is as follows. When there is little or no fluid pressure acting on the drivers 14 and 16 and control valve assembly 18, the component parts of the various drivers and control valve will assume those positions schematically represented in FIG. 1. It will be understood, however, that cam member 12 can be angularly shifted such that driver 14 is urged against a crown section 32 and driver 16 acts as a detent on the fillet radius 38.

Upon operation, and assuming cam member 12 is oriented as shown in the drawings, a relatively high fluid pressure is introduced to port 44 of driver 14 and port 72 of driver 16. A regulated and relatively high fluid pressure is introduced to port 116 of the control valve assembly 18 from the pressure regulator assembly 186. As seen in FIG. 2, the fluid pressure at port 44 of driver 14 is blocked by land 58 of the valve spool 40. As such, roller 50 of driver 14 acts against the cam profile 28 under a relative low pressure force created by spring 56. Moreover, in the position shown, land 58 prevents fluid pressure flow to port 46. Therefore, the lack of a pressure signal from driver 14 indicates to control valve assembly 18 that roller 50 is disposed in or proximate to a fillet radius 38.

The relatively high fluid pressure introduced at port 72 of driver 16, however, is allowed to pass to port 74 across the peripheral groove 90. The relatively high fluid pressure passing to port 74 acts as a pressure signal to the control valve assembly 18. That is, the fluid pressure passing to port 74 is presented to port 122 of control valve 18 and acts as a pressure signal indicating that driver 16 is disposed on or proximate to a crown section 32. By such logic, control valve assembly 18 sends high pressure operating force to the proper driver.

As mentioned above, upon initial operation of the indexing mechanism, the shuttle spool 100 is urged to the right under the influence of spring 158 whereat it is in position to accept a pressure signal from driver 16. That is, with shuttle spool 100 so disposed, port 122 opens to orifice 152, defined by shuttle spool 100. As such, relatively high pressure fluid passes from port 74 to port 122, through orifice 152, and enters the axial bore 138 behind the pilot spool 101 in a manner shifting the pilot spool 101 leftward to the position shown in FIG. 2.

In addition to the signal fluid pressure presented to control valve assembly 18 from driver 16, regulated and relatively high fluid pressure is presented to port 116 of control valve 18 from fluid pressure regulator 186. As best seen in FIG. 2, regardless of its position within axial bore 138, orifice 140, defined by shuttle spool 100, is in fluid communication with the regulated fluid presented to port 116 of control valve assembly 18. With pilot spool shifted to the left as seen in FIG. 2, regulated fluid pressure from regulator 186 passes from port 116, through orifice 140, across groove 172 and into orifice 144. From orifice 144 the regulated fluid pressure will flow through axial bore 156 and be exhausted into fluid chamber 108. As illustrated in the drawings, the pressurized fluid directed into the fluid cavity 108 will forcibly move shuttle spool 100 leftward, in a delayed fashion, against the action of the spring 158 until the shuttle spool 100 impinges against a stop 159 defined by closure member 104 and into the position shown in FIG. 2.

Fluid pressure, if any, in chamber 106 is exhausted to port 112. That is, any fluid in chamber 106 passes through axial bore 154, into orifice 142. From orifice 142, of pilot spool 101 fluid passes across groove 170 and through orifice 146 into the port 112 from whence it is exhausted.

With the control valve assembly 18 so disposed, the regulated and relatively high fluid pressure force delivered to port 116 is likewise directed to chamber 82 of driver 16. The relatively high fluid pressure force delivered to chamber 82 places driver 16 in a driving phase of operation. More specifically, with control valve assembly 18 so disposed, the shuttle spool 100 will direct regulated fluid pressure from port 116 across peripheral groove 134 of valve 100 to port 114. From port 114, regulated high pressure fluid is directed to fluid chamber 82 of the driver 16 whereby urging roller 80 against a crown section 32 of the cam member 12.

As will be appreciated, chamber 54 of driver 14 is connected to exhaust port 120 through port 118 and across groove 136 of spool valve 100. As such, driver 14 imparts a relatively low level of force (derived from spring 56) on the roller 52. With roller 52 acting against a fillet radius 38, however, such a low level of force is sufficient to position cam member 12 in a distinct angular orientation and against rotation about its axis.

Figure 3:
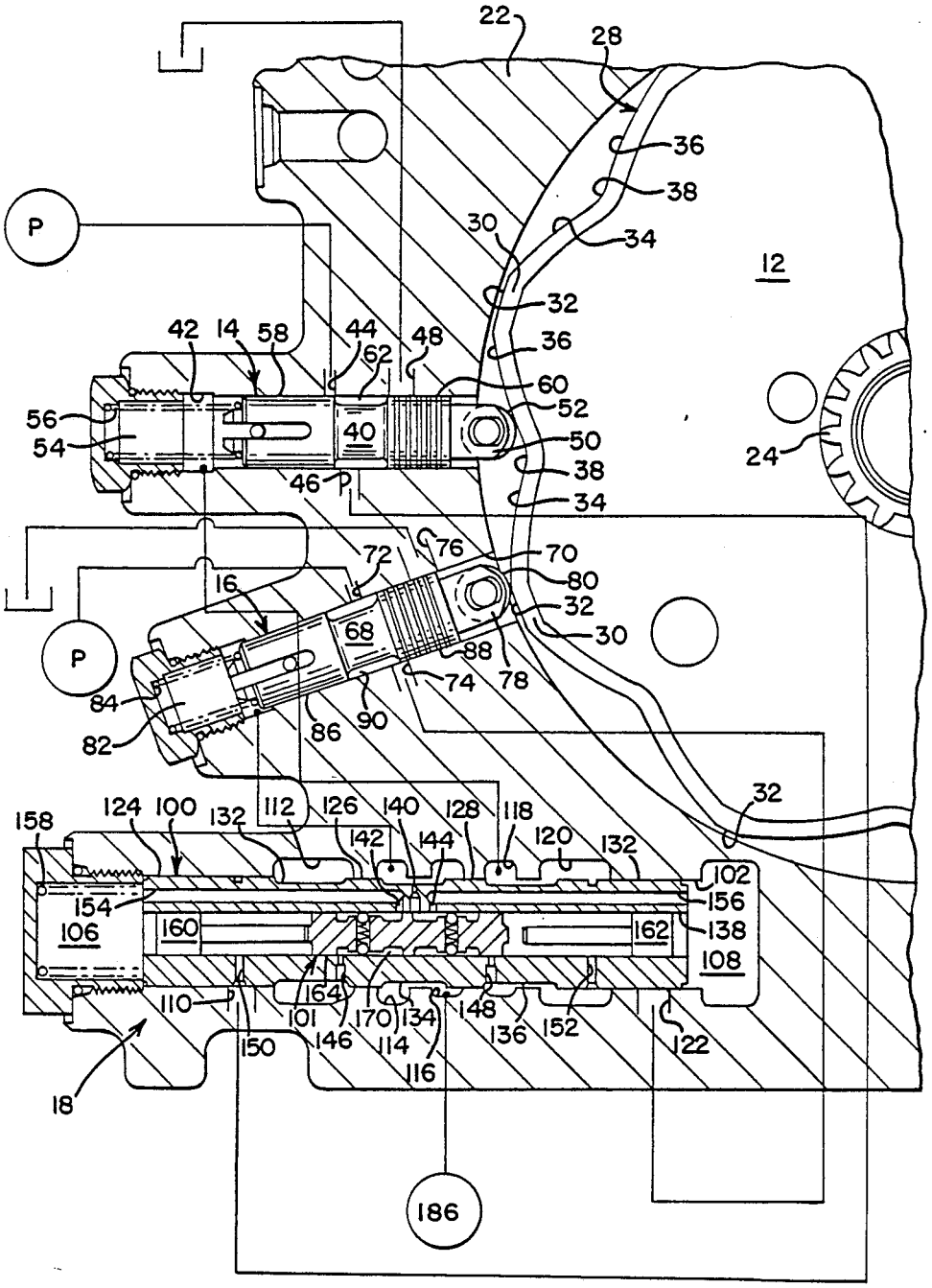

When the operator chooses to cause indexed movement of the cam member 12, gear or rack 26 is moved in a manner effecting a certain small incremental movement of the cam member 12 (approximately 3° ). As seen in FIG. 3, when cam member 12 is rotated, driver 14 is linearly moved in the axial bore 42 to the left by the cam profile 28 of cam member 12. The effort required to rotate the cam 12 is determined by only the light spring force acting on the driver 14 and the ramp angle on the profiled surface 28 of the cam member 12. It should be noted that, albeit powered with a relatively high driving force, driver 16 does not move axially (because crown section is designed as a circular "flat", i.e., a chord defined by the axis of rotation of member 12) and therefore driver 16 remains in its driving phase of operation but does not offer any significant resistance to this small increment of rotation. Therefore, only low efforts are required to overcome the spring force of driver 14 to begin the indexing operation.

As soon as roller 80 of driver 16 moves off crown section and onto a ramp 34, the relatively high driving force acting on the driver 16 starts to rapidly motor the cam member 12 to a new position. The relatively high fluid pressure force acting on the driver 16, conjointly with the action of spring 84, pushes the valve spool 68 and thereby the roller 80 down the ramp 34 toward the fillet radius 38 in a manner sufficient to rapidly rotate or index the cam. The profile of the ramp is such that the driver provides a constant torque on the cam member 12.

After indexing the cam member 12 into position, the driving roller 80 arrives at the fillet radius 38 of the cam track whereat it will prevent further cam rotation. The relatively high driving force acting on driver 16 holds the cam member 12 in position for a certain time and prevents the cam from "overshooting." The relatively high driving force acting on driver 16 will thereafter be significantly reduced and the driver 16 will be operated in its positioning phase of operation.

A reduction in the pressure acting against driver 16 is effected in the following manner. As seen in FIG. 3, as driver 14 begins to linearly move to the left, under the influence of cam member 12, land 60 on valve spool 40 blocks port 48 which opens to exhaust. Simultaneously, valve spool 40 is sufficiently shifted to allow communication between ports 44 and 46. As such, the high pressure operating fluid delivered to port 44 from pump 184 is directed across groove 62 to port 46. From port 46 the relatively high pressure fluid is directed to port 110 whereby signaling a change in the orientation of cam member 12. Because shuttle spool 100 remains positioned to the left, as seen in FIG. 3, the fluid directed to port 110 passes through port 150 into the axial bore 138 in a manner forcibly shifting the pilot spool 101 to the right.

Figure 4:
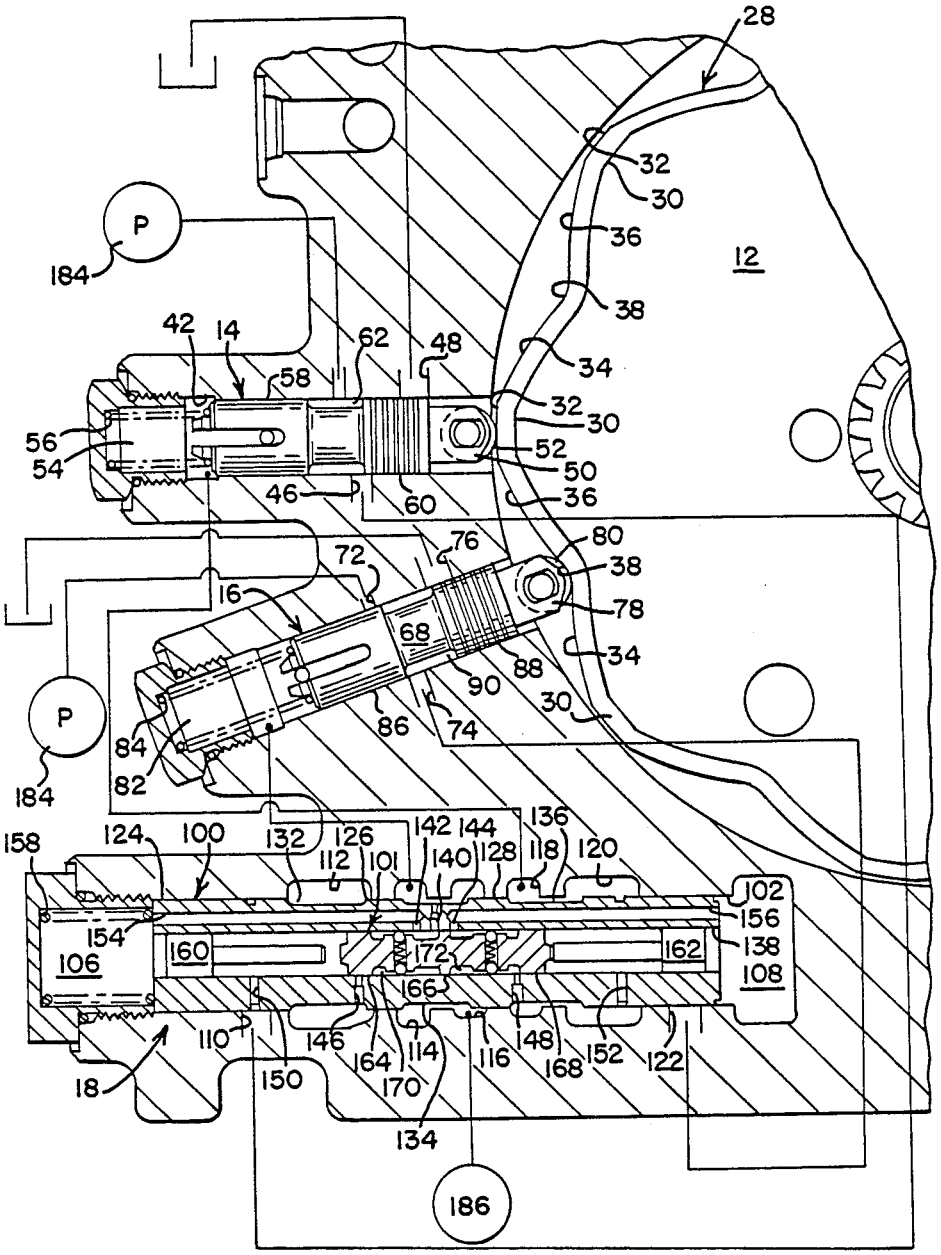

As best seen in FIG. 4, with pilot spool 101 shifted to the right, regulated high pressure fluid presented to port 116 is directed ultimately to chamber 106. More specifically, the high pressure fluid presented to port 116 passes through orifice 140, across groove 170 and enters orifice 142. From orifice 142 high pressure fluid travels through axial bore 154 and is exhausted into chamber 106 whereby creating pressure therein which acts against the left side of the shuttle spool 100. Simultaneously therewith, the chamber 108 is open to exhaust through axial bore 156 and orifice 144 which communicates with exhaust through orifice 148 and port 120.

The time required to move the shuttle spool 100 is determined by the size of orifice 140. As will be appreciated, the size of orifice 140 regulates the fluid flow to and, thereby, the pressure delivered to the ends of the shuttle spool 100. Moreover, the size of orifices 146 and 148 delays the fluid exhaustion from chambers 106 and 108. Because orifices 150 and 152 are symmetrically arranged relative to orifice 140 and are evenly spaced with regard to orifices 110 and 122, the operation of control valve assembly 18 is completely symmetrical. As such, movement of driver 14 can be traced in substantially the same manner as that described above.

As should be appreciated, if neither drive roller 52 or 80 lies in a fillet radius 38 on the cam profile 28, the shuttle spool 100 will continuously "hunt" between extreme leftward and extreme rightward positions. The shuttle spool 100 will not travel to either a left or right end extreme position but will oscillate just a small distance from either side of its center position. Such action is effected by the location of ports 110 and 122 with respect to the orifices 150 and 152. As will be understood, when pressure is available at both ports 110 and 122, the shuttle spool 100 will stop moving leftward and start moving rightward after orifice 150 opens to port 110. Similarly, the shuttle spool will stop moving rightward and start moving leftward after orifice 152 opens to pressurized port 122. Such a design allows quick shifting of the cam member 12 through several indexed positions without a large resistance to its movement.

Only when one of the drive rollers 52, 80 arrives in a fillet radius and stays there will the shuttle spool 100 stop "hunting" and assume an extreme position at either end of the axial bore 102. An extreme position for shuttle spool 100 at either end of the axial bore 102 is caused by port 110 or 122 being open to exhaust. Therefore, that port which is open to exhaust will not be sufficiently pressurized to shift the pilot spool 101.

Spring 158 acts to influence the disposition of shuttle spool 100 when little or no pressure is acting thereon. When the pressure delivered to port 116 is discontinued or is relatively small, the shuttle spool 100 will be urged to the right, as seen in FIG. 4, under the influence of the spring 158 regardless of the angular position of cam member 12. Thus, when a higher fluid pressure flow is again delivered to port 116, driver 14 will be initially pressurized tending to force cam member 12 into a predetermined position unless it is exactly in a position whereat driver 16 will position the cam member.

The brake assemblies 174 and 176 carried by the pilot spool 101 act to prevent the pilot spool 101 from shifting, as a result of the inertia forces imparted thereto, when shuttle spool 100 rapidly moves from one position to another in opposite directions. Thus, such brake assemblies prevent the pilot spool 101 from "floating" into a center position when no pressure signal is delivered from either of the drivers 14 or 16.

Thus, there has been described numerous modifications and variations which can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. An indexing mechanism comprising: a member adapted to be advanced a predetermined amount and along a predetermined path, said member defining a profile surface including a plurality of spaced tooth segments, each tooth segment having a crown section which is joined to an adjacent crown section by two oppositely directed ramps defining a fillet radius therebetween, each fillet radius being spaced from a crown section a predetermined distance;

a pair of spaced apart drivers which are urged against the profile surface of the member, the spacing between said drivers being such that when one driver is urged against a crown section the other driver acts against a fillet radius, and wherein each driver includes a valve spool reciprocally arranged in a ported valve body and a roller connected to said valve spool to act against said profile surface, with said valve spool and roller being resiliently urged toward said profile surface under the influence of a spring; and means for supplying a driving force to each driver in an alternative manner such that a driver, after moving off said crown section, coacts with a ramp to impart a driving force to said member, said driving force being sufficient to move said member with a constant torque said predetermined amount.

2. An indexing mechanism according to claim 1 wherein said crown section includes an extended flat which permits limited movement of said member before a driver coacts with a ramp to impart a driving force to said member.

3. An indexing mechanism according to claim 1 wherein the fillet radius defined between said ramps is slightly greater than a radius of said roller to provide relatively small acceleration forces.

4. An indexing mechanism according to claim 1 wherein each valve spool is operably interposed between a source of fluid pressure and said means for supplying a driving force.

5. An indexing mechanism according to claim 1 wherein said means for supplying a driving force includes a shuttle spool adapted for linear sliding movement in said ported valve body in response to pressure signals from said drivers.

6. An indexing mechanism according to claim 5 wherein the linear position of said shuttle spool in said valve body controls which driver has a driving force imparted thereto.

7. An indexing mechanism according to claim 1 wherein said member is a cam adapted to regulate operation of a transmission.

8. An indexing mechanism comprising: a rotatable member adapted to be advanced into distinct angular positions, said member defining a profiled peripheral surface including a plurality of spaced tooth segments, each tooth segment having a generally flat crown section which is joined to an adjacent crown section by at least two oppositely directed ramps defining a fillet radius therebetween;

a pair of spaced, hydraulically operated drivers which are urged against the profiled surface of said member, the spacing between such drivers being such that when one driver is urged against a crown section the other driver acts against a fillet radius, and wherein each driver includes a valve spool reciprocally arranged in a ported valve body, a roller connected to the valve spool and urged against the profiled surface of said member, and a spring which acts against the valve spool in a manner urging said valve spool and roller toward said rotational member, and wherein the fillet radius defined between said ramps being slightly larger than a radius of said roller; and means for supplying a pressurized source of fluid to each of said drivers in an alternative manner such that a driver, after moving off said crown section, pushes against a ramp whereby imparting sufficient torque to said member to rotationally advance said member while the other driver moves toward a crown section.

9. An indexing mechanism according to claim 8 wherein said rotatable member is a cam which comprises part of a transmission control assembly.

10. An indexing mechanism according to claim 8 wherein said valve spool is interposed between a source of pressurized fluid and said supplying means.

11. An indexing mechanism comprising: a cam which is rotatable about an axis and is mounted for advancement into distinct angular positions, said cam defining a profiled surface including a plurality of spaced radial segments, each radial segment having a crown section which is joined to an adjacent crown section by at least two oppositely directed ramps defining a fillet radius therebetween;

first and second cam drivers arranged to follow and be resiliently urged against the profiled surface of said cam, each of said cam drivers being operable in a driving phase and a positioning phase and includes a valve spool reciprocally arranged in a valve body which supports said cam for rotation, wherein said cam drivers are arranged relative to each other such that when one cam driver acts against a crown section the other dam driver is arranged to act against a fillet radius; and means for regulating application of a driving force to said cam drivers in an alternative manner such that the cam drivers in an alternative manner such that the cam drivers are operated 180° out of phase relative to each other, wherein said regulating means includes a shuttle spool reciprocally arranged in said valve body for linear movement along a straight line path, the linear position of said shuttle spool being regulated by the arrangement of each valve spool in said valve body.

12. An indexing mechanism according to claim 11 wherein said cam comprises part of a transmission control assembly.

13. An indexing mechanism according to claim 11 wherein each cam driver includes a roller which coacts with one of said ramps to provide a constant torque on the cam during the driving phase and then coacts with a fillet radius to position the cam during the positioning phase.

14. An indexing mechanism according to claim 11 wherein each valve spool is operably interposed between a source of fluid pressure and said regulating means.

15. An indexing mechanism according to claim 11 wherein said shuttle spool includes a pilot spool coaxially arranged to reciprocate in said shuttle spool in a manner regulating fluid flow to each cam driver.

16. An indexing mechanism comprising: a rotatable member adapted to be advanced into distinct angular positions, said member defining a profiled peripheral surface including a plurality of spaced tooth segments, each tooth segment having a generally flat crown section which is joined to an adjacent crown section by at least two oppositely directed ramps defining a fillet radius therebetween;

a pair of spaced, hydraulically operated drivers which are urged against the profiled surface of said member, the spacing between such drivers being such that when one driver is urged against a crown section the other driver acts against a fillet radius, and wherein each of said drivers further includes a valve spool reciprocally arranged in a ported valve body and a roller which is connected to the valve spool and is urged against the profiled surface of the member, and wherein the fillet radius defined between said ramps being slightly larger than a radius of said roller; and means for supplying a pressurized source of fluid to each of said drivers in an alternative manner such that a driver, after moving off said crown section, pushes against a ramp whereby imparting sufficient torque to said member to rotationally advance said member while the other driver moves toward a crown section, with said means for supplying a pressurized source of fluid including a shuttle spool arranged in said valve body for movement along a linear path, the linear position of said shuttle spool being regulated by the position of each valve spool in said valve body.

17. An indexing mechanism according to claim 16 wherein said shuttle spool includes a pilot spool coaxially arranged to reciprocate in said shuttle spool in a manner regulating in response to fluid pressures acting thereon and the linear position of said shuttle spool.

18. An indexing mechanism comprising: a cam which is rotatable about an axis and is mounted for advancement into distinct angular positions, said cam defining a profiled surface including a plurality of spaced radial segments, each radial segment having a crown section which is joined to an adjacent crown section by at least two oppositely directed ramps defining a fillet radius therebetween;

first and second cam drivers arranged to follow and be resiliently urged against the profiled surface of said cam, each of said cam drivers being operable in a driving phase and a positioning phase, wherein said cam drivers are arranged relative to each other such that when one cam driver acts against a crown section the other cam driver is arranged to act against a fillet radius; and means for regulating application of a driving force to said cam drivers in an alternative manner such that the cam drivers are operated 180° out of phase relative to each other, wherein said regulating means includes a shuttle spool reciprocally arranged in a valve body for linear movement along a straight line path, the linear position of said shuttle spool being regulated by the position of each cam driver relative to the profiled surface of the cam.

* * * * *